United States Patent [19]

Sykora et al.

[11] 4,185,767

[45] Jan. 29, 1980

[54] ORNAMENTAL PACKAGE STRUCTURE

[75] Inventors: John M. Sykora, Chicago; Theodore W. Pollack, Streamwood, both of Ill.

[73] Assignees: Field Container Corporation, Elk Grove Village, ; by said John M. Sykora; Mogen David Wine Corporation, Chicago, both of Ill. ; by said Theodore W. Pollack

[21] Appl. No.: 923,978

[22] Filed: Jul. 12, 1978

[51] Int. Cl.[2] ..... B65D 5/10

[52] U.S. Cl. ..... 229/39 R; 229/8

[58] Field of Search ..... 229/8, 39 R; 206/457

[56] References Cited

U.S. PATENT DOCUMENTS

| | | | |
|---|---|---|---|
| 1,523,246 | 1/1925 | Berkowitz | 229/39 R X |
| 3,153,503 | 10/1964 | Goldstein | 229/8 |
| 3,443,739 | 5/1969 | Adams, Jr. | 229/39 R |
| 3,549,081 | 12/1970 | Nelson | 229/39 R |
| 3,768,720 | 10/1973 | Bundy | 229/39 R X |

FOREIGN PATENT DOCUMENTS

| | | | |
|---|---|---|---|
| 1174578 | 11/1958 | France | 229/8 |
| 1307317 | 9/1962 | France | 229/8 |
| 1559856 | 2/1969 | France | 229/39 R |
| 671810 | 10/1964 | Italy | 229/39 R |
| 262693 | 10/1949 | Switzerland | 229/8 |
| 264157 | 1/1950 | Switzerland | 229/8 |

*Primary Examiner*—Davis T. Moorhead

*Attorney, Agent, or Firm*—Wallenstein, Spangenberg, Hattis & Strampel

[57] ABSTRACT

An ornamental package structure for packaging a product is formed of resilient semi-rigid sheet stock and includes a container portion for the product and a closure portion comprising a plurality of top flaps joined to the closure portion along substantially horizontal fold lines. Each of the top flaps has an ornamentation tab projecting upwardly from the outer edge of the top of the flap from one side of the approximate center thereof. The top flaps are folded inwardly to a substantially horizontal position for closing the top of the package with a part of each top flap and the ornamentation tab projecting therefrom overlying the next adjacent top flap, wherein the projection ornamentation tabs provide ornamentation for the closed top of the package and wherein side edges of the projecting ornamentation tabs extend from substantially the center of the closed top of the package. The ornamentation is substantially three-dimensional and attractive and, preferably, represents a ribbon bow.

15 Claims, 5 Drawing Figures

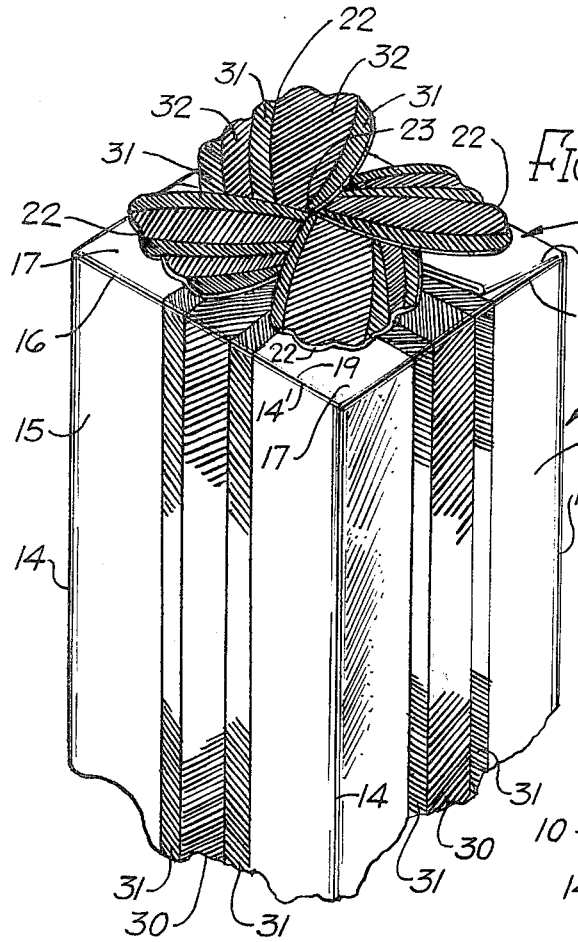
FIG. 1
FIG. 3
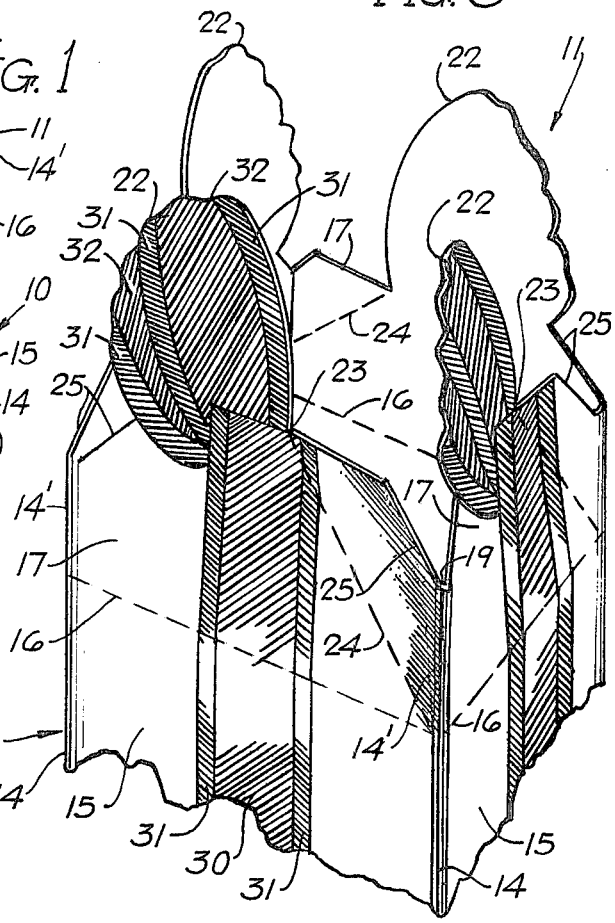
FIG. 2
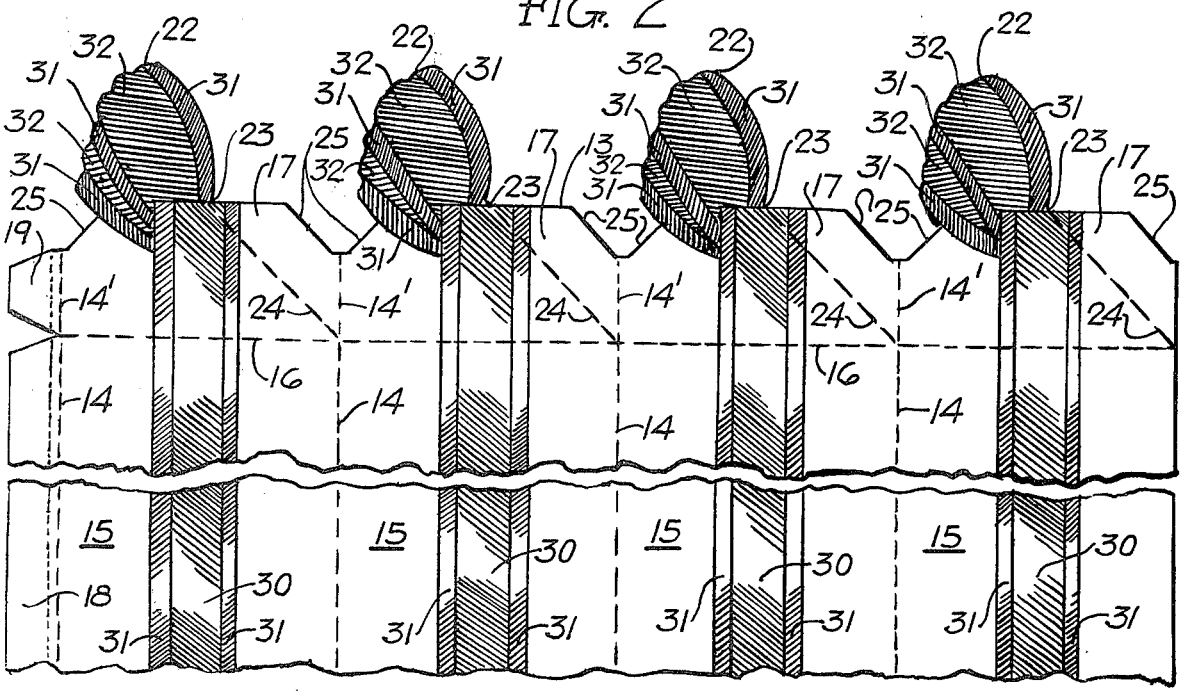

ORNAMENTAL PACKAGE STRUCTURE

This invention relates to an ornamental or decorative package structure for packaging a product and is especially concerned with such packaging as applied to consumer products.

In the marketing of many products, such as beverages, and the like, it is often desirable to package the products in a highly ornamental or decorative manner so as to enhance gift sales during holiday seasons, and the like. Conventionally, such gift packages have been decorated by imprinting the same, which provides only planar ornamentation or decoration, or by bows and ribbons, or other three-dimensional ornamentation, which are difficult, time consuming and expensive in being applied to the packages. Package ornamentations or decorations of the latter type are frequently and easily damaged in handling and/or shipping. Damage can also occur in wrapping at the point of sale for distribution to the ultimate user. Where package ornamentation or decoration of the latter type are applied at the point of origin, other attendant disadvantages and problems occur, as for example, those related to shelf size since many standard existing shelf heights do not provide the requisite head room for such ornamentation or decorations, and those related to packaging and shipping cartons requiring larger cartons to accommodate such ornamental or decorative packages and, hence, greater handling and shipping costs.

An attempt to overcome some of the aforementioned disadvantages and problems for packages having three-dimensional ornamentation or decoration is disclosed in U.S. Pat. No. 3,153,503 of Daniel Goldstein. In that patent, the package for the product comprises a container in the form of a box having side walls and a top and a separate ornamental accessory or attachment connected to the container. The separate ornamental attachment is formed of manually deformable flexible sheet material, such as foil or the like, which may be bent or deformed downwardly over the container for handling and shipping purposes or may be bent or deformed upwardly for three-dimensional ornamentation purposes. The ornamental attachments may be simulate leafs, flower petals or the like. Such ornamental packages, having separate ornamental attachments applied to the containers, are relatively expensive, and require application of the attachments to the container, folding of the attachments against the containers for shipping and handling purposes and unfolding the attachments from the containers for three-dimensional ornamentation purposes, all expensive and time consuming procedures.

The principal object of this invention is to provide an ornamental package structure for packaging a product wherein the aforementioned disadvantages and problems are avoided, wherein separate ornamental attachments are eliminated, wherein the ornamentation is relatively inexpensive, wherein the ornamental package may be readily handled and shipped and wherein three-dimensional ornamentation is automatically obtained.

Briefly, in accordance with this invention, the ornamental package structure for packaging the product is formed of resilient semi-rigid sheet stock, such as cardboard or the like, which may be paper faced for imprinting or the like purposes, and includes a container portion for the product and a top closure portion which comprises a plurality of top flaps joined to the container portion along substantially horizontal fold lines. Each of the top flaps has an ornamentation tab projecting upwardly from the outer edge of the top flap from one side of the approximate center thereof.

The top flaps are foldable inwardly on their associated substantially horizontal fold lines to a substantially horizontal position for closing the top of the package with a part of each top flap and the ornamentation tab projecting therefrom overlying the next adjacent top flap. When the top flaps and their ornamentation tabs are folded flat, the height of the package is a minimum and the packages are readily accommodated in conventional shelving and in conventional packaging or shipping cartons having minimal height dimensions for handling or shipping purposes. When, however, the ornamental packages are removed from the shelving or the packaging or shipping cartons, the resiliency of the resilient and semi-rigid sheet stock of the packages automatically causes the top flaps and the ornamentation tabs thereon to swing upwardly somewhat from the horizontal fold lines to provide three-dimensional ornamentation for the closed top of the package.

Side edges of the projecting ornamentation tabs extend from substantially the center of the closed top of the package to provide centrally oriented ornamentation. Preferably, the projecting ornamentation tab of each top flap is provided, by imprinting or the like, with representations of a portion of a ribbon bow so that the ornamentation tabs of the top flaps represent a three-dimensional ribbon bow when the top flaps are folded inwardly for closing the top of the package. Also, preferably, the container portion and the top flaps of the closure portion are provided, by imprinting or the like, with representations of a ribbon which extend into the representations of the ribbon bow when the top flaps are folded inwardly for closing the top of the package. Also, the top flaps preferably have recessed portions at the outer edges thereof where the corners of the flaps would normally be so that when the top flaps are folded inwardly for closing the top of the package, the recessed portions thereof expose the representation of the ribbon on the next adjacent top flap which they overlie.

Package or container structures including a container portion and a top closure portion which comprises a plurality of top flaps joined to the container portion along fold lines are known to the art. They may take various configurations and forms and utilize various interfolding, interleaving and interlocking top flaps to form the top closure portion proper. Illustrative thereof is U.S. Pat. No. 3,549,081 which, briefly, in this respect, in an embodiment thereof, shows a disposable container structure for receiving and temporarily storing waste materials or the like, having a top closure portion in the form of a plurality of top flaps joined to the container portion along substantially horizontal fold lines and to each other along substantially vertical fold lines and wherein each of the top flaps has a diagonal fold line running from a corner of the flap adjacent the container portion to the approximate center of the upper edge of the flap. The top flaps are folded inwardly on their substantially vertical and horizontal and diagonal fold lines for closing the top of the container. There is no disclosure nor any concept therein of any package structure which deals with an ornamental and, specifically, a bow or ribbon configuration such as provided by this invention, nor is there any disclosure or concept of ornamentation tabs projecting from the top flaps for forming and recessed portions in the top flaps for exposing the ornamentation.

While the ornamental package of this invention may utilize various interfolding and interleaving top flaps having ornamentation projections for providing the closure portion of the package having the three-dimensional ornamentation, the top flaps preferably have substantially horizontal and vertical and diagonal fold lines along which the top flaps are inwardly folded to close the package with the ornamentation tabs overlying the next adjacent top flaps. This provides for a simple folding manipulation without the need for interleaving the top flaps or the like, and the multiple fold lines provide increased resiliency to cause the top flaps and the ornamental tabs thereon automatically to swing upwardly more readily to provide the three-dimensional ornamentation.

The products are preferably placed in the ornamental packages at the point of origin and the packaged products handled and shipped to the point of sale in shipping cartons containing the same. On the other hand, the products may be placed in the ornamental packages at the point of sale, if this be desired.

Other objects of this invention reside in the details of the ornamental package structure and in the cooperative relationships between the component elements thereof.

Further objects and advantages of this invention will become apparent to those skilled in the art upon reference to the accompanying specification, claims and drawings in which:

FIG. 1 is a perspective view of the upper portion of the ornamental package structure of this invention illustrating the package structure in closed condition and the three-dimensional ornamentation on the top thereof.

FIG. 2 is a plan view of the upper portion of the blank of sheet stock from which the ornamental package is formed.

FIG. 3 is a perspective view similar to FIG. 1 illustrating the blank of FIG. 2 formed into a multi-walled tube with the top of the package open for receiving a product therein.

Figure 4:
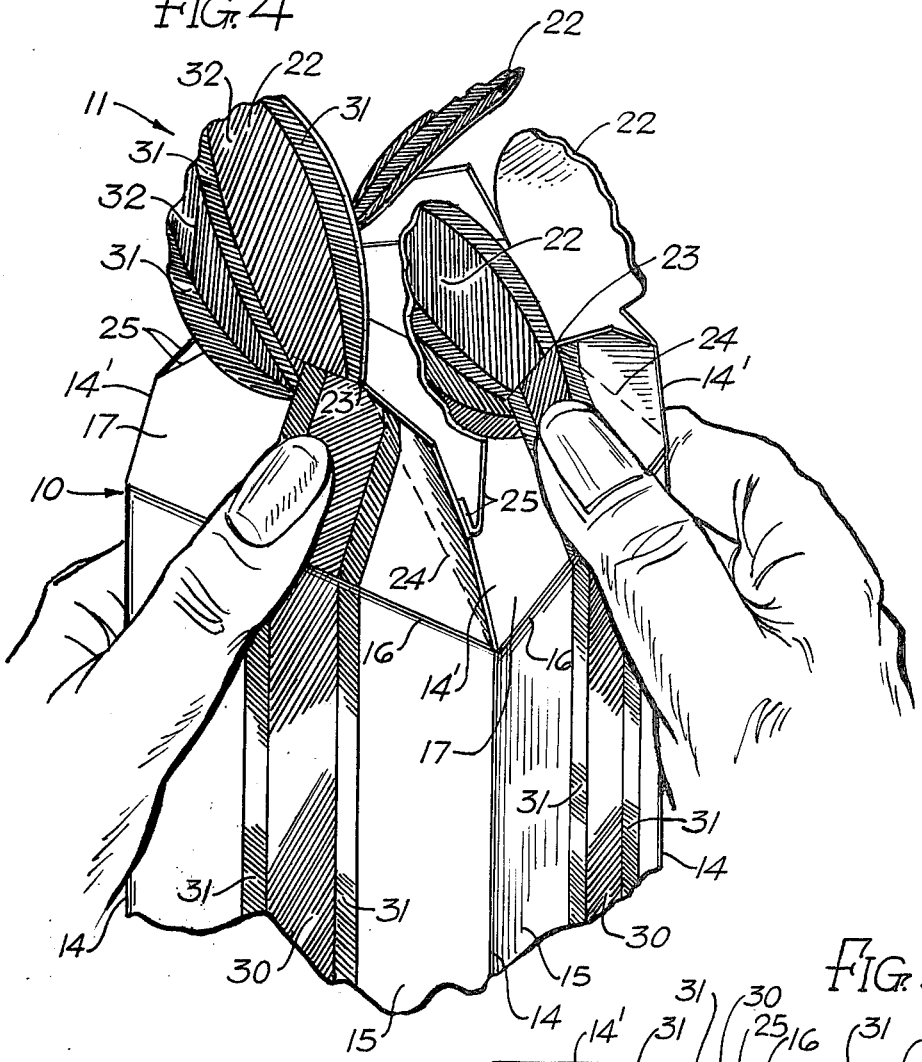
FIG. 4 is a perspective view similar to FIGS. 1 and 3 and illustrating the manner in which the top of the package is closed from the open position in FIG. 3 to the closed position in FIG. 1.

Referring first to FIGS. 1 and 3 to 5, the ornamental package structure of this invention includes a container portion generally designated at 10 and a closure portion generally designated at 11.

The ornamental package structure is formed from a blank 13, as illustrated in FIG. 2, of resilient semi-rigid sheet stock, such as cardboard or the like, which preferably has a paper laminate secured to its surface for imprinting purposes. The blank 13 is provided with a plurality of substantially vertically arranged fold lines 14 which provide a plurality of walls 15 for the container portion 10 of the package. The blank 13 is also provided with a substantially horizontal fold line 16 which forms top flaps 17 for the closure portion 11 of the package. The substantially vertical fold lines 14 extend into the top flaps 17 as illustrated at 14'. One edge of the blank 13 is provided with an extension 18 at the container portion 10 and with an extension 19 at the closure portion 11, the extensions 18 and 19 having adhesive or glue patterns thereon, which are utilized for forming a multi-walled tube therefrom as illustrated in FIG. 3. In forming the multi-walled tube, the blank 13 is folded along the substantially vertical fold lines 14, 14'.

Each of the top flaps 17 has an ornamental tab 22 projecting upwardly from the outer edge of the top flap from one side of the approximate center 23 thereof. The top flaps 17 each have a diagonal fold line 24 running from a corner of the flap 17 adjacent its respective panel section 15 to the approximate center 23 of the upper edge of the flap and these diagonal fold lines 24 are substantially parallel to each other. The fold lines 14, 14' and 24 may be conventionally formed, as by scoring, intermittent slitting or slotting, or the like, the fold lines being resilient in nature and tending automatically to somewhat straighten out. The flaps 17 at the outer edges thereof where the corners of the flaps would normally be have recessed portions 25.

The side walls 15 of the container portion and the flaps 17 of the closure portion of the package are preferably imprinted with representations of a ribbon 30 which may have a different color edging as indicated at 31. The projecting ornamentation tab 22 of each top flap 17 is provided with representations of a portion of a ribbon bow as indicated at 32 and such ribbon bow representations also may have the different colored edging 31.

Figure 5:
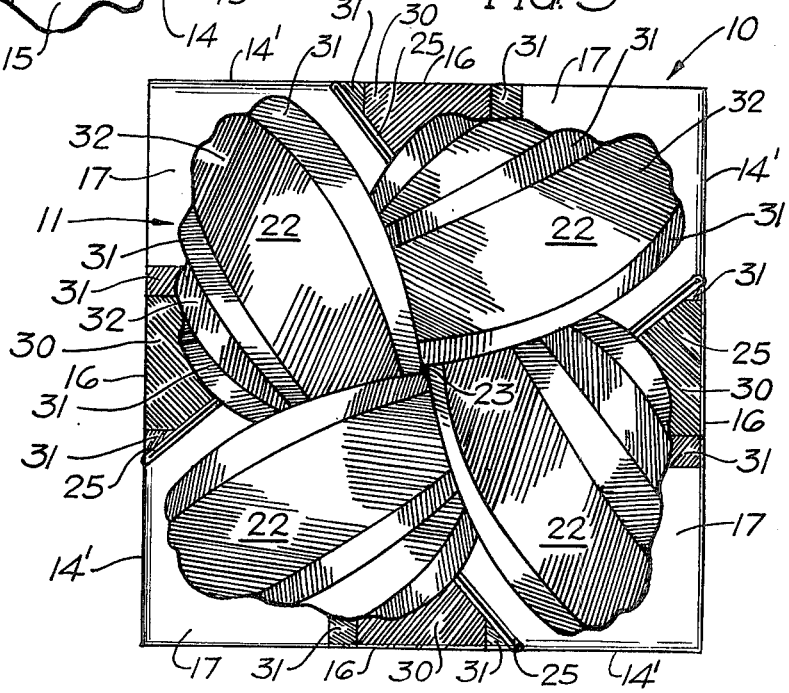
FIG. 5 is a top plan view of the ornamental package illustrated in FIG. 1 with the package closed.

When the ornamental package is open as illustrated in FIG. 3, and a product, such as a bottled beverage or the like, is inserted in the container portion 10 of the package, the top portion 11 of the package may be closed in the manner indicated in FIG. 4. In this respect, the top flaps 17 are folded inwardly on their associated substantially vertical fold lines 14', their associated substantially horizontal fold lines 16 and their diagonal fold lines 24 to a substantially horizontal position as illustrated in FIGS. 1 and 5 for closing the top of the package. The representations of the ribbon bow portions 32 operate to represent a ribbon bow when the top flaps 17 are folded inwardly for closing the top of the package with side edges of the projecting ornamentation tabs 22 extending from substantially the center 23 of the closed top of the package. The representations 30 of the ribbon on the side walls of the container portion and the top flaps 17 meld or merge with the representation of the ribbon bow, since the ornamentation tabs 22 of each top flap overlie the next adjacent flap, all as illustrated in FIGS. 1 and 5. The recesses 25 in the top flaps 17 expose the representation of the ribbon 30 on the next adjacent top flap 17 which they overlie.

When the ornamental package is closed as discussed above, the closure portion 11 formed by the top flaps 17 is preferably folded flat so that the packaged product may be readily handled and shipped in shipping cartons containing the same. When, however, the packaged products are removed from the shipping cartons, the resiliency of the resilient semi-rigid sheet stock is such as to cause the top flaps automatically to spring upwardly somewhat so as to provide the three-dimensional ornamentation as illustrated in FIG. 1, and this is particularly pronounced when, in accordance with the preferred form of this invention, the resilient and substantially vertical and horizontal and diagonal fold lines 14', 16 and 24, respectively, are utilized.

The bottom of the package may be closed in any conventional manner by bottom flaps or the like, but since this forms no part of the instant invention it has not been disclosed herein, the bottom part of the package being broken away in the various figures of the drawings.

While for purposes of illustration, one preferred form of this invention has been disclosed, other forms thereof may become apparent to those skilled in the art upon reference to this disclosure and, accordingly, this invention is to be limited only by the scope of the appended claims.

We claim:

1. An ornamental package structure for packaging a product and formed of resilient semi-rigid sheet stock and including a container portion for the product and a top closure portion wherein said top closure portion comprises a plurality of top flaps joined to the container portion along substantially horizontal fold lines, wherein each of said top flaps has an ornamentation tab projecting upwardly from the outer edge of the top flap from one side of the approximate center thereof, wherein said top flaps are foldable inwardly on their associated substantially horizontal fold lines to a substantially horizontal position for closing the top of the package with a part of each top flap and the ornamentation tab projecting therefrom overlying the next adjacent top flap, wherein the projecting ornamentation tabs provide three-dimensional ornamentation for the top of the package when said top is closed, and wherein side edges of the projecting ornamentation tabs extend from substantially the center of the top of the package when closed.

2. An ornamental package structure as defined in claim 1 wherein said top flaps have recessed portions at the outer edges thereof where the corners of the flaps would normally be so that when the top flaps are folded inwardly for closing the package, the recessed portions thereof expose the next adjacent top flap which they overlie.

3. An ornamental package structure as defined in claim 1 wherein the projecting ornamentation tab of each top flap is provided with representations of a portion of a ribbon bow so that the ornamentation tabs of the top flaps represent a ribbon bow when the top flaps are folded inwardly for closing the top of the package.

4. An ornamental package structure as defined in claim 3 wherein the container portion and the top flaps of the closure portion are provided with representations of a ribbon which extend into the representation of the ribbon bow when the top flaps are folded inwardly for closing the top of the package.

5. An ornamental package structure as defined in claim 4 wherein said top flaps have recessed portions at the outer edges thereof where the corners of the flaps would normally be so that when the top flaps are folded inwardly for closing the top of the package, the recessed portions thereof expose the representation of the ribbon on the next adjacent top flap which they overlie.

6. An ornamental package structure for packaging a product and formed of resilient semi-rigid stock and including a container portion for the product and a top closure portion wherein said top closure portion comprises a plurality of top flaps joined to the closure portion along substantially horizontal fold lines and to each other along substantially vertical fold lines, wherein each of said top flaps has a diagonal fold line running from a corner of said flap adjacent the container portion to the approximate center of the upper edge of said flap with said diagonal fold lines being substantially parallel to each other, wherein each of said top flaps has an ornamentation tab projecting upwardly from the outer edge of the top flap from one side of said approximate center thereof, wherein said top flaps are foldable inwardly on their associated substantially vertical and horizontal and diagonal fold lines to a substantially horizontal position for closing the top of the package with a part of each top flap and the ornamentation tab projecting therefrom overlying the next adjacent top flap, wherein the projecting ornamentation tabs provide three-dimensional ornamentation for the top of the package when said top is closed, and wherein side edges of the projecting ornamentation tabs extend from substantially the center of the top of the package when closed.

7. An ornamental package structure as defined in claim 6 wherein said top flaps have recessed portions at the outer edges thereof where the corners of the flaps would normally be so that when the top flaps are folded inwardly for closing the package, the recessed portions thereof expose the next adjacent top flap which they overlie.

8. An ornamental package structure as defined in claim 6 wherein the projecting ornamentation tab of each top flap is provided with representations of a portion of a ribbon bow so that the ornamentation tabs of the top flaps represent a ribbon bow when the top flaps are folded inwardly for closing the top of the package.

9. An ornamental package structure as defined in claim 8 wherein the container portion and the top flaps of the closure portion are provided with representations of a ribbon which extend into the representation of the ribbon bow when the top flaps are folded inwardly for closing the top of the package.

10. An ornamental package structure as defined in claim 9 wherein said top flaps have recessed portions at the outer edges thereof where the corners of the flaps would normally be so that when the top flaps are folded inwardly for closing the top of the package, the recessed portions thereof expose the representation of the ribbon on the next adjacent top flap which they overlie.

11. An ornamental package structure for packaging a product comprising a multi-walled tube of resilient semi-rigid sheet stock, wherein said walls are joined to each other along substantially vertical fold lines, wherein each of said walls is divided into a panel section and a top flap, wherein said top flaps are joined to said panel section along substantially horizontal fold lines and to each other along said substantially vertical fold lines, wherein each of said top flaps has a diagonal fold line running from a corner of said flap adjacent its respective panel section to the approximate center of the upper edge of said flap with said diagonal fold lines being substantially parallel to each other, wherein each of said top flaps has an ornamentation tab projecting upwardly from the outer edge of the top flap from one side of said approximate center thereof, wherein said multi-walled tube is folded along said substantially vertical fold lines for receiving the product to be packaged therein, wherein said top flaps are foldable inwardly on their associated substantially vertical and horizontal and diagonal fold lines to a substantially horizontal position for closing the top of the package, wherein a part of each top flap and the projecting ornamentation tab thereof overlie the next adjacent top flap when the top flaps are folded inwardly for closing the top of package, wherein the projecting ornamentation tabs provide three-dimensional ornamentation for the top of the package when said top is closed, and wherein side edges of the projecting ornamentation tabs extend from substantially the center of the top of the package when closed.

12. An ornamental package structure as defined in claim 11 wherein said top flaps have recessed portions at the outer edges thereof where the corners of the flaps would normally be so that when the top flaps are folded inwardly for closing the package, the recessed portions thereof expose the next adjacent top flap which they overlie.

13. An ornamental package structure as defined in claim 11 wherein the projecting ornamentation tab of each top flap is provided with representations of a portion of a ribbon bow so that the ornamentation tabs of the top flaps represent a ribbon bow when the top flaps are folded inwardly for closing the top of the package.

14. An ornamental package structure as defined in claim 13 wherein the container portion and the top flaps of the closure portion are provided with representations of a ribbon which extend into the representation of the ribbon bow when the top flaps are folded inwardly for closing the top of the package.

15. An ornamental package structure as defined in claim 14 wherein said top flaps have recessed portions at the outer edges thereof where the corners of the flaps would normally be so that when the top flaps are folded inwardly for closing the top of the package, the recessed portions thereof expose the representation of the ribbon on the next adjacent top flap which they overlie.

* * * * *